US008800931B2

(12) United States Patent
Vander Lind

(10) Patent No.: US 8,800,931 B2
(45) Date of Patent: Aug. 12, 2014

(54) PLANFORM CONFIGURATION FOR STABILITY OF A POWERED KITE AND A SYSTEM AND METHOD FOR USE OF SAME

(75) Inventor: Damon Vander Lind, Oakland, CA (US)

(73) Assignee: Google Inc., Mountain View, CA (US)

( * ) Notice: Subject to any disclaimer, the term of this patent is extended or adjusted under 35 U.S.C. 154(b) by 248 days.

(21) Appl. No.: 13/070,157

(22) Filed: Mar. 23, 2011

(65) Prior Publication Data

US 2011/0260462 A1 Oct. 27, 2011

Related U.S. Application Data

(60) Provisional application No. 61/341,029, filed on Mar. 24, 2010.

(51) Int. Cl.
*A63H 27/08* (2006.01)
*B64C 31/06* (2006.01)

(52) U.S. Cl.
USPC ..... 244/154; 244/155 A; 446/31

(58) Field of Classification Search
USPC ..... 244/1 R, 153 R, 154, 155 R, 155 A; 446/30, 31, 33
See application file for complete search history.

(56) References Cited

U.S. PATENT DOCUMENTS 4,166,596 A * 9/1979 Mouton et al. ..... 244/30
D255,469 S * 6/1980 Deptula ..... D21/446
4,486,669 A * 12/1984 Pugh ..... 290/44
4,659,940 A * 4/1987 Shepard ..... 290/55
5,056,447 A * 10/1991 Labrador ..... 114/39.26
5,145,129 A 9/1992 Gebhard
5,435,259 A * 7/1995 Labrador ..... 114/39.31
6,523,781 B2 * 2/2003 Ragner ..... 244/153 R
6,781,254 B2 * 8/2004 Roberts ..... 290/55
7,093,803 B2 8/2006 Culp
7,183,663 B2 * 2/2007 Roberts et al. ..... 290/44
7,188,808 B1 3/2007 Olson
7,317,261 B2 * 1/2008 Rolt ..... 290/55
7,335,000 B2 * 2/2008 Ferguson ..... 417/7
7,602,077 B2 * 10/2009 Ferguson ..... 290/55
7,675,189 B2 * 3/2010 Grenier ..... 290/54
7,775,761 B2 * 8/2010 Ferguson ..... 415/7
7,859,126 B2 * 12/2010 Ferguson ..... 290/44
8,109,711 B2 * 2/2012 Blumer et al. ..... 415/2.1
8,148,838 B2 * 4/2012 Ferguson ..... 290/44
8,350,403 B2 * 1/2013 Carroll ..... 290/55
2004/0075028 A1 4/2004 Wang
2009/0292407 A1 11/2009 Minelli et al.
2010/0013226 A1 * 1/2010 Blumer et al. ..... 290/44
2010/0026007 A1 * 2/2010 Bevirt ..... 290/55
2010/0032947 A1 * 2/2010 Bevirt ..... 290/44

(Continued)

OTHER PUBLICATIONS

International Search Report prepared by the U.S. Patent Office in International Application Serial No. PCT/US11/29855, mailed Jul. 20, 2011.

*Primary Examiner* — Benjamin P Lee
(74) *Attorney, Agent, or Firm* — McDonnell Boehnen Hulbert & Berghoff LLP

(57) ABSTRACT

A system and method of power generation, wind based flight, and take off and landing using a tethered kite with a raised tail mounted rearward of the main wing or wings. The tail may be fully rotatable and may be adapted to rotate more than 90 degrees from its nominal position during a traditional flight paradigm.

21 Claims, 11 Drawing Sheets

(56) References Cited

U.S. PATENT DOCUMENTS

| | | | | |
|---|---|---|---|---|
| 2010/0032948 | A1* | 2/2010 | Bevirt | 290/44 |
| 2010/0221112 | A1 | 9/2010 | Bevirt et al. | |
| 2010/0230546 | A1* | 9/2010 | Bevirt et al. | 244/175 |
| 2010/0230547 | A1* | 9/2010 | Tayman | 244/7 C |
| 2010/0283253 | A1 | 11/2010 | Bevirt | |
| 2010/0295320 | A1* | 11/2010 | Bevirt et al. | 290/55 |
| 2010/0295321 | A1 | 11/2010 | Bevirt | |
| 2010/0308174 | A1* | 12/2010 | Calverley | 244/155 A |
| 2011/0042508 | A1 | 2/2011 | Bevirt et al. | |
| 2011/0042509 | A1 | 2/2011 | Bevirt et al. | |
| 2011/0042510 | A1 | 2/2011 | Bevirt et al. | |
| 2011/0121570 | A1* | 5/2011 | Bevirt et al. | 290/44 |
| 2011/0127775 | A1* | 6/2011 | Bevirt | 290/55 |
| 2011/0186687 | A1* | 8/2011 | Elder | 244/155 A |
| 2011/0260462 | A1* | 10/2011 | Vander Lind | 290/55 |
| 2011/0266395 | A1* | 11/2011 | Bevirt | 244/155 R |
| 2011/0266809 | A1* | 11/2011 | Calverley | 290/55 |
| 2011/0272527 | A1* | 11/2011 | Larson | 244/155 A |
| 2012/0104763 | A1* | 5/2012 | Lind | 290/55 |
| 2012/0112008 | A1* | 5/2012 | Holifield et al. | 244/155 A |

* cited by examiner

PLANFORM CONFIGURATION FOR STABILITY OF A POWERED KITE AND A SYSTEM AND METHOD FOR USE OF SAME

CROSS-REFERENCE TO RELATED APPLICATIONS

This application claims priority to U.S. Provisional Application No. 61/341,029 to Damon Vander Lind, filed Mar. 24, 2010, which is hereby incorporated by reference in its entirety.

BACKGROUND

Field of the Invention

This invention relates to airborne flight and power generation systems, and more specifically to an airborne vehicle configured to maintain pitch control during tethered take-off and landing.

BRIEF DESCRIPTION OF THE DRAWINGS

Various embodiments of the invention are disclosed in the following detailed description and the accompanying drawings.

DETAILED DESCRIPTION

Figure 1:
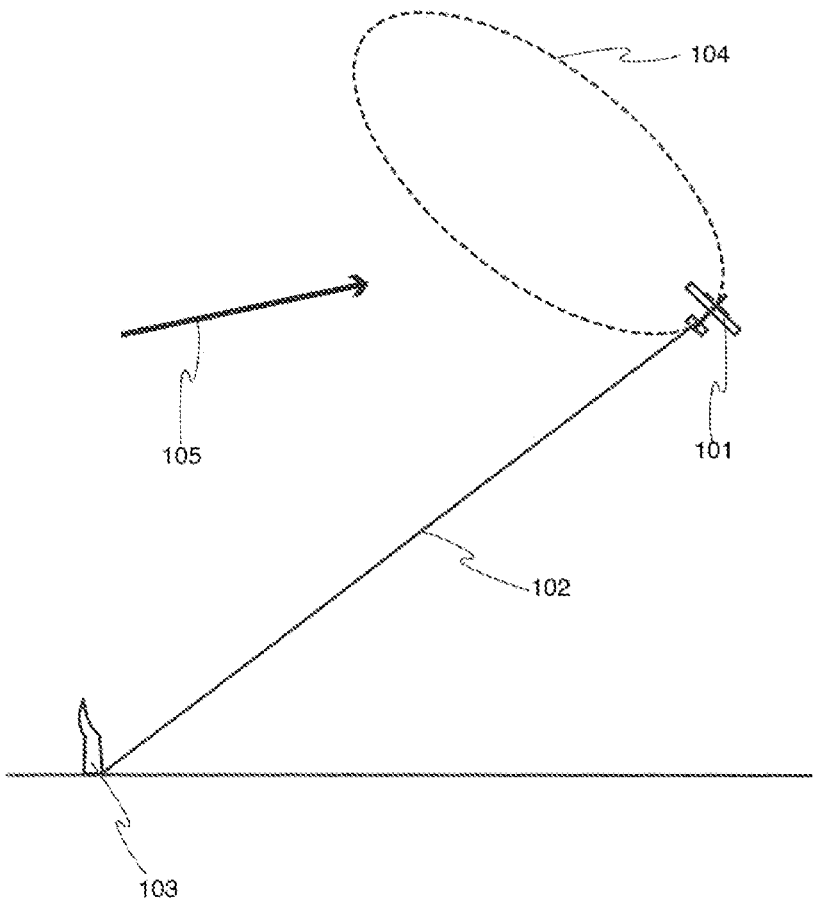
FIG. 1 is a diagram illustrating an embodiment of a tethered kite system according to some embodiments of the present invention.

The invention can be implemented in numerous ways, including as a process; an apparatus; and a system. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A configuration of aerodynamic surfaces and actuators useful in the launch, hover, transition, and landing of a powered kite is disclosed. In some embodiments, the powered kite comprises a main wing, a tail wing, and may comprise a number of other wings. The kite is connected to a tether which is connected to the ground or some other object. The kite comprises a number of rotors, which are used to generate thrust with the input of power or generate power at the cost of drag. The tail wing of the powered kite is located behind and above the center of mass and tether attachment location on the powered kite in the aerodynamic frame of the crosswind or static modes of flight. The tail wing is partially or fully actuated such that the tail wing maintains primarily attached aerodynamic flow and augments the stability of the kite when the kite is transitioning to and from the hovering mode of flight and while the wing is in the hovering mode of flight. The placement and actuation of the tail foil in the manner described improves the aerodynamic stability and increases the aerodynamic control authority in some modes of flight over a range of environmental conditions including conditions associated with a range of wind magnitudes, a range of wind directions, and a range of other qualities of wind.

A powered kite which is flown both in the manner of a tethered aircraft and in the manner of a tethered helicopter can be designed to incorporate aerodynamic surfaces that improve the pitch-axis aerodynamic stability of the craft in both modes of flight while having no significant detrimental effects on the stability in other axes. When flying in the manner of an aircraft on a string, the kite must primarily control or passively attenuate tension on the tether through the pitch axis of the kite in order to increase fatigue life or decrease tether and wing structural size and mass. When hovering in the manner of a helicopter, the kite must have adequate control authority on the pitch axis to prevent uncontrollable excitation of the tether by gusts of wind. Control of the pitch axis in both modes of flight may be improved by an all-moving tail high above and behind the main wing. When flying as a tethered airplane, the tail wing acts in the manner of a normal tail. Additionally, in some embodiments, the tail may add a stabilizing effect through tailoring of the tail wing airfoil drag coefficient such that it produces higher drag at negative angles of attack and lower drag at positive angles of attack, in a manner which increases the stability of the powered kite. When hovering, the apparent wind on the kite is roughly perpendicular to the main wing of the kite. When rotated 90 degrees to the main wing such that it faces into the wind while hovering, the tail wing provides a restoring moment. While it is possible to build a powered kite without this particular configuration of the aerodynamic surfaces, such a kite necessarily requires faster and more accurate control signals, and is thus less robust against sensor noise and component failure. While a tail on an aircraft can be placed in a similar location relative to the main wing for the purpose of keeping the horizontal tail out of the wake of the main wing, it does not serve the same purpose of canceling the aerodynamic moment about either or both the center of mass and tether attachment point when the main wing of the kite is either roughly parallel or roughly perpendicular to the perceived wind. It additionally does not serve the purpose of reducing excitation of the tether from wind while hovering.

In some embodiments of the present invention, as seen in FIG. 1 a powered kite 101 is adapted to fly while tethered. In some embodiments, the kite 101 comprises one or more airfoil elements with turbine driven generators mounted thereon. The kite 101 is attached by tether 102 to object 103, which may be a ground unit. In some embodiments, the ground unit may include winding and/or winching elements adapted to extend or to reel out the tether. In some embodiments, the tether 102 comprises both structural and electrical conductive aspects. The ground unit may be adapted to receive electrical energy routed from the kite 101 via tether 102. In some embodiments, kite 101 may operate in a crosswind mode of flight. Kite 101 may also fly in other modes of flight, including the stationary mode of flight and the hovering mode of flight. Kite 101 may be adapted to transition between the aforementioned modes of flight.

In some embodiments, kite 101 takes off from the ground in the hovering mode of flight and transitions into the crosswind mode of flight, for the purpose of electrical power generation. In some embodiments, the ground unit may include aspects adapted to support the kite while on the ground. In some embodiments, the kite is a positioned in a vertical configuration such that the "front" of the kite faces upward while constrained in the ground unit. In some embodiments, the system is adapted to begin a power generation mode with the kite constrained in the ground unit in such a manner. The turbine driven generators may be adapted to also function as motor driven propellers. The kite may use the motor driven propellers to provide thrust vertically downward in order to take off from the ground and raise to a desired altitude. As the kite increases its altitude, the ground unit may extend the tether. In some embodiments, the tether tension is monitored during the take off portion of a flight of the kite. At a desired altitude, the kite may begin a transition from the substantially vertical take-off mode to a regular flight mode, as described below. At the end of a flight, the kite 101 may transition out of a regular mode of flight into the hover mode of flight to land.

In some embodiments, after transitioning from hovering mode the kite 101 may fly in a regular, stationary flight mode at the end of the tether 102. In some embodiments, the kite 101 may fly in crosswind flight patterns. In some embodiments, the crosswind flight pattern may be substantially circular. In some embodiments, other flight patterns may be flown. In the crosswind mode of flight, kite 101 flies on flightpath 104 at an inertial velocity of equal or greater order of magnitude to the wind velocity 105. In various embodiments, flightpath 104 comprises a path through space, a path through a parameter space including prescribed targets through the path for power generation, tether tension, or other measurable variable, or any other appropriate path. In various embodiments, parameters comprise one or more of the following: tension on tether 102, load on kite 101, angular rotation rate of kite 101, or any other appropriate parameter.

In the stationary mode of flight, kite 101 flies at a small inertial velocity compared to wind velocity 105. In this mode of flight, the majority of the lift holding kite 101 aloft comes from the flow of wind 105 over wings of kite 101.

When transitioning between modes of flight, kite 101 changes from one mode of flight to another mode of flight. In various embodiments, the transition modes of flight comprise highly dynamic maneuvers, slow maneuvers in nearly static balance, or any other appropriate maneuvers.

Figure 2:
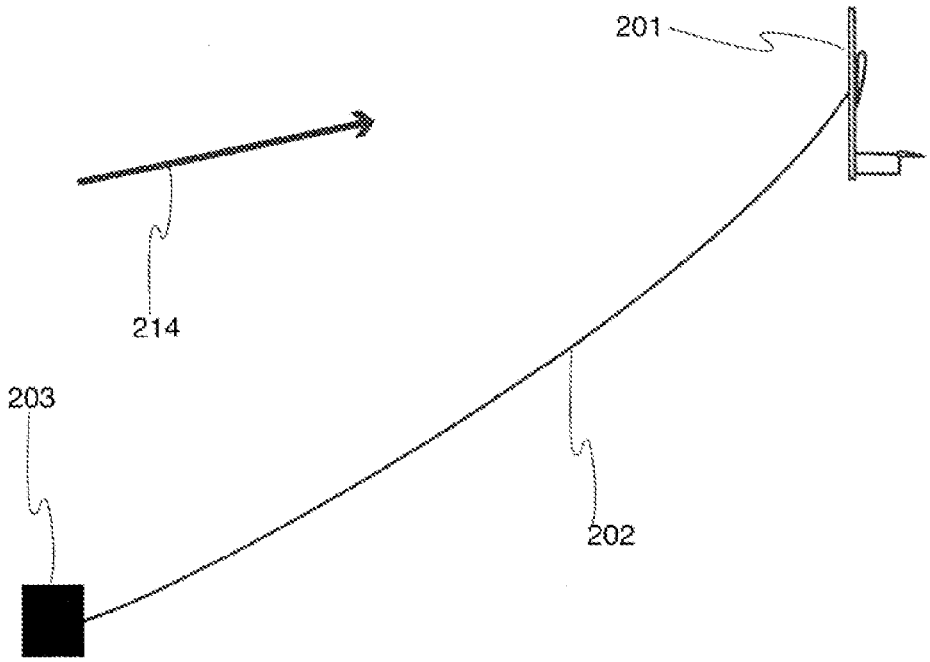
FIG. 2 is a diagram illustrating a powered kite system in hover mode according to some embodiments of the present invention.

FIG. 2 is a diagram illustrating an embodiment of a powered kite in the hovering mode of flight. In some embodiments of the present invention, the hovering mode of flight kite 201 uses rotors or some other means of on-board power to create thrust to oppose the force of gravity and to maintain position or move to a target position. In some embodiments, the turbine driven generators used to generate electrical energy while in crosswind flight mode may also function as motor driven propellers while in hover mode. Some force to oppose gravity may still be derived from wings of kite 201. In this mode of flight, the apparent wind 214 is roughly perpendicular to the orientation of kite 201. Object 203 may be a ground station which supplies power to rotors on kite 201 to generate on-board thrust. In some embodiments, power to the rotors is provided by a power source on kite 201.

In various embodiments, object 203 comprises a base station attached to the ground, a ship, a cart, a payload not affixed to the ground, or any other appropriate object to which tether 202 is attached. In some embodiments, object 203 supplies power to kite 201 when thrust is being output by rotors on kite 201 and receives power from kite 201 when rotors are generating power at the expense of drag. In some embodiments, kite 201 uses on-board power such as batteries or a gas engine to provide power to rotors as needed.

Tether 202 comprises a high strength material to convey mechanical force from kite 201 to object 203. Tether 202 includes an electrical element to convey electrical power to kite 201 from object 203 or from object 203 to kite 201. In some embodiments, the electrical and mechanical elements of tether 202 are the same element. In some embodiments, tether 202 comprises elements to convey other forms of energy. In various embodiments, tether 202 comprises a fixed length tether, a variable length tether, or has any other appropriate characteristic or property for a tether. In some embodiments, tether 202 is able to be reeled in on a spool associated with object 203 or on a spool associated with kite 201.

Figure 3A:
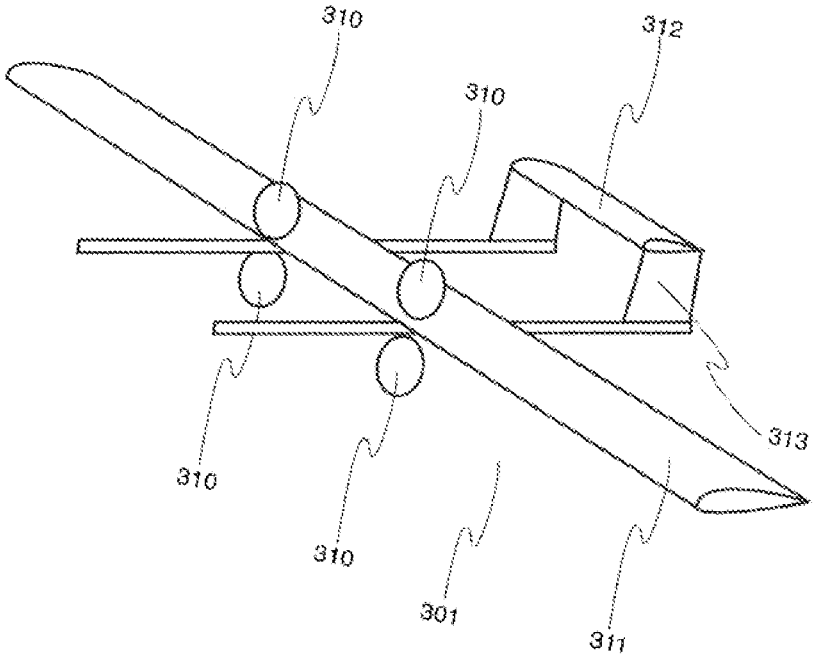
FIG. 3A is a sketch of a powered kite according to some embodiments of the present invention.
Figures 5A, 5B:
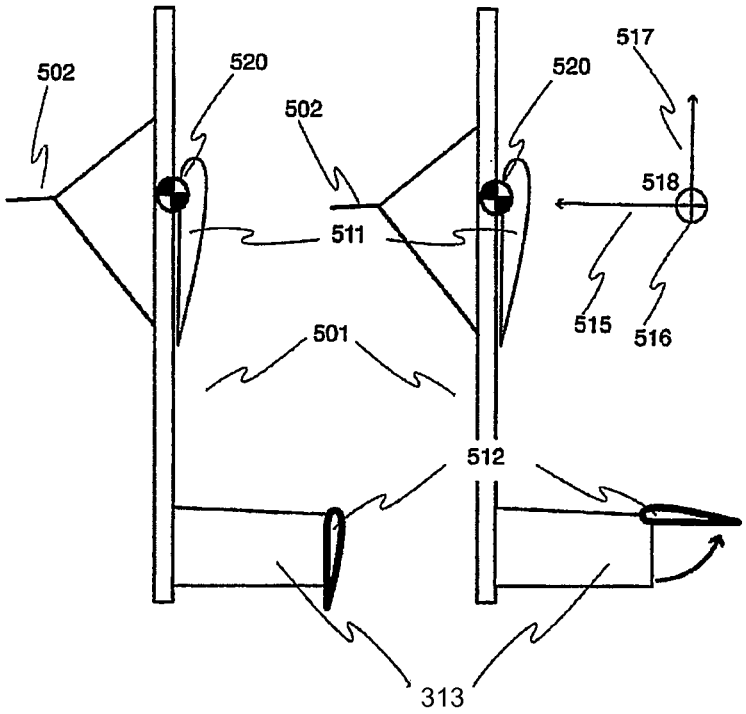
FIG. 5A is a diagram of a powered kite showing a first orientation of the tail wing according to some embodiments of the present invention.
FIG. 5B is a diagram of a powered kite showing a second orientation of the tail wing according to some embodiments of the present invention.

In some embodiments of the present invention, as seen in FIG. 3A a kite is adapted to fly in the various flight modes discussed above. In some embodiments, the kite 301 of FIG. 3A is used to implement kite 101 in the system of FIG. 1 or to implement kite 201 in the system of FIG. 2. In the example shown, kite 301 comprises a plurality of turbine/propellers, hereafter rotors 310. The rotors 310 comprise aerodynamic surfaces connected to a means of actuation which are used to generate power in the manner of a wind turbine, at the expense of increased drag, or are used to create thrust by the input of electrical or mechanical power. In some embodiments, the rotors 310 comprise an electric motor/generator connected to a fixed or variable pitch propeller. In various embodiments, a motor associated with a rotor of rotors 310 comprises a gas motor, the aerodynamic surface comprises a flapping wing, or the rotor comprises any other actuated aerodynamic surface capable of converting airflow into mechanical power or mechanical power into airflow. In some embodiments, rotors 310 are used to extract power or apply thrust while kite 301 is flying in the crosswind mode of flight along a flightpath, or in the static mode of flight, or is used to apply thrust when kite 301 is hovering (e.g., as depicted in FIG. 5B). In some embodiments, rotors 310 are only capable of producing thrust. In various embodiments, rotors 310 comprise four individual rotors, a single individual rotor, or any other appropriate number of individual rotors or other aerodynamic actuators.

In the example shown, the kite 301 comprises a plurality of wings, for example, two wings 311 and 312. The main wing 311 comprises the main wing surface of the kite 301, and provides the majority of aerodynamic force in some modes of flight. In some embodiments, the main wing 311 comprises multiple wing sections. The tail wing 312 comprises the rearward wing surface of kite 301, and provides a smaller aerodynamic force primarily used to achieve stability and maintain a balance of forces and moments for the kite 301. In some embodiments, the tail wing 312 comprises many wing sections. In various embodiments, the kite 301 comprises other wings, such as wing 313, which are used for the generation of further lift, for further augmentation of the stability of the kite 301, to reduce the drag of some structural element of kite the 301, or for some other appropriate purpose. In some aspects, the wings 311, 312 and 313, and any other wings which the kite 301 comprises, and rotors 310 are connected by structural supports (e.g., spars).

In various embodiments, main wing 311, tail wing 312, the wings 313, and other wing surfaces on the kite 301 comprise rigid single element airfoils, flexible single element airfoils, airfoils with control surfaces, multiple element airfoils, or any other combination of airfoil types. In some embodiments, control surfaces on some wings on the kite 301 are deflected in the hover mode of flight in order to modify the aerodynamic properties or change the stability properties of the kite 301. In various embodiments, deflection of the trailing or leading element of a multi-element airfoil on a wing is used to induce stall for the desired portion of the transitions between flight modes, to change the center of aerodynamic pressure on that wing in the hovering mode of flight, or to stabilize the aerodynamic flow around the wing in a manner which reduces load variability on the wing in the hovering mode of flight.

Figure 3B:
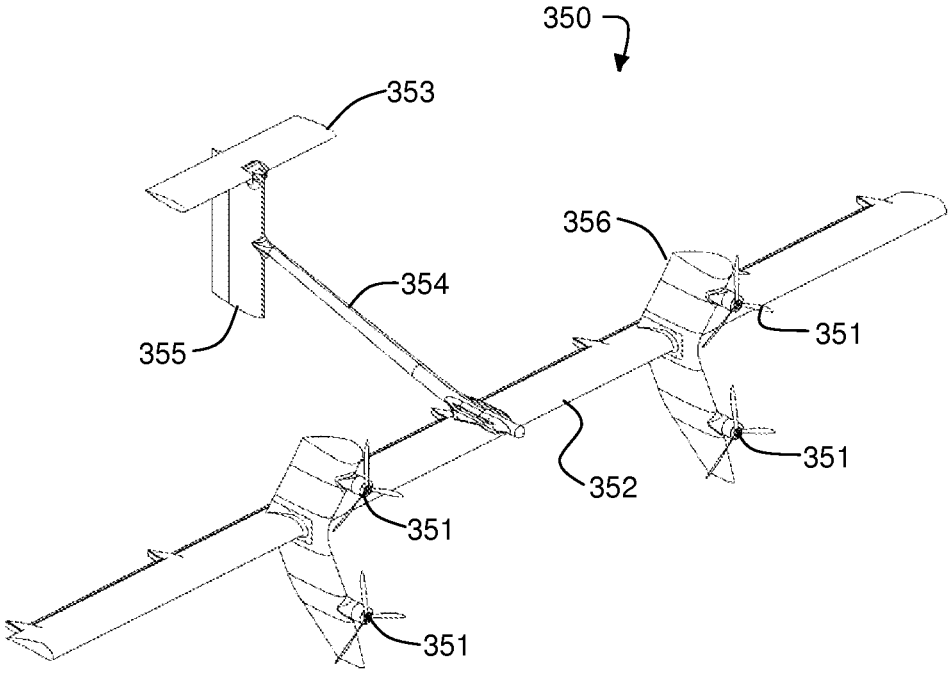
FIG. 3B is a sketch of a powered kite according to some embodiments of the present invention.

FIG. 3B is an illustrative example of a kite 350 according to some embodiments of the present invention. In this illustrative example, a main wing 352 provides the primary lift for the kite 350. The main wing 352 has a wingspan of 8 meters. The area of the main wing 352 is 4 square meters, and the main wing 352 has an aspect ratio of 15. Four turbine driven generators 351 are mounted to the main wing 352 using pylons 356. The vertical spacing between the turbines is 0.9 meters, equally spaced above and below the main wing 352. The turbine driven generators are adapted to also function as motor driven propellers in a powered flight mode, or in hover mode. The propeller radius is 36 cm. A tail boom 354 is used to attach the rearward control surfaces to the main wing 352, and by extension, to the tether. The length of the tail boom is 2 meters. A vertical stabilizer 355 is attached to the rear of the tail boom 354. Atop the vertical stabilizer 355 is the tail wing 353. The tail wing 353 is 1 meter above the center of mass of the kite 350. The tail wing surface area is 0.45 square meters. The kite 350 may be flown on a 140 meter tether in some embodiments.

Although illustrated herein with a single element airfoil, in some embodiments the airfoil may comprise a plurality of elements. In some embodiments, there may be stacked airfoils, or other airfoil configurations.

Figure 4:
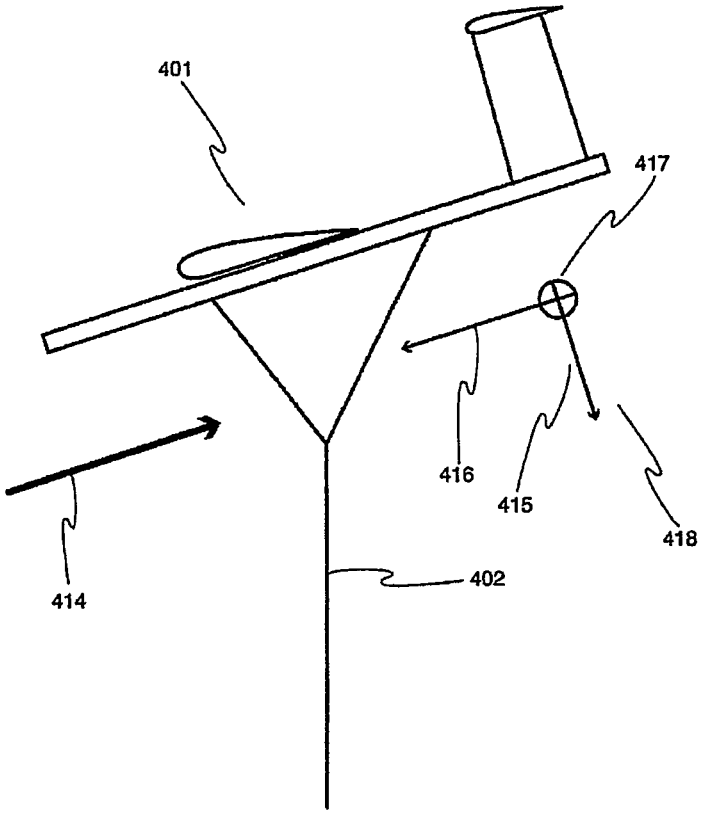
FIG. 4 is a diagram illustrating powered kite in crosswind flight, and associated coordinate system and apparent wind vector, according to some embodiments of the present invention.

FIG. 4 is a diagram illustrating an embodiment of a kite. In the example shown, kite 401 is flying in either the crosswind or static modes or flight. Kite 401 flies into an apparent wind 414 equal to the vector addition of the inertial velocity of the kite to the inertial velocity of the wind. The locations of various elements comprising kite 401 is denoted in coordinate frame 418. In coordinate frame 418, axis 416 on the kite, anti-parallel to apparent wind 414, is denoted as 'x'. 'Z'-axis 415 points opposite the direction of lift when kite 401 is flying in the crosswind mode of flight. 'Y'-axis 417 is perpendicular to both 'x' axis 416 and 'z' axis 415 in a manner which gives a right-handed coordinate system when the coordinates are listed in the order ['x', 'y', 'z'].

In various embodiments, tether 402 is attached to kite 401 at one location, at two locations (e.g., to one side of the wing and to the another side of the wing or toward the front of the kite and toward the back of the kite), at a number of points on the kite (e.g., four) and where the tether is attached to a number of other bridles that attach to the number of points, or any other number of appropriate locations either directly or indirectly using bridles and/or any other appropriate connectors. In various embodiments, tether 402 is attached rigidly at a single point on kite 401 through all modes of flight, is attached in a manner that the center of rotation changes depending on the direction of force from the tether or due to some other variable, or any other appropriate manner of attachment. In various embodiments, the center of rotation of tether 402 on kite 401 is controlled by a linkage, a configuration of ropes or cables or some other appropriate mechanism. In some embodiments, tether 402 is affixed directly to kite 401. In some embodiments, tether 402 is attached to kite 401 in a manner such that the center of rotation tether 402 is different on different axes. In various embodiments, tether 402 is attached so that it can be released from kite 401, is permanently affixed, or is attached in any other appropriate manner.

In some embodiments, the raised aspect of the tail wing relative to the main wing, as viewed with the kite in a horizontal configuration, allows for an additional method of pitch control of the kite while the kite is in hover mode. With the kite facing vertically upward, the center of the lift of the tail wing resides rearward of the kite in a manner that allows changes in lift of the tail wing to use the lever arm of the rearward distance (the amount that the tail wing was above the main wing in the horizontal configuration) to put a moment around the center of gravity of the hovering kite. This force generated with the change in lift, levered around the distance behind the center of mass of the kite, puts a torque into the system such that changes in pitch of the kite can be controlled. As the kite may oscillate in pitch during maneuvers and hovering, a further rearward position ("raised position" in horizontal flight mode) of the tail wing during hover mode allows for some pitching of the kite while still maintaining the rearward aspect relative to vertical from ground. In some embodiments, the kite may be expected to pitch backward 10 degrees due to dynamic changes in wind, wind gusting, and for other reasons. In more extreme cases, 20 degrees of pitch variation may be seen. With a 10 degree design margin designed in beyond that, a design may be desired such that the center of lift of the tail wing is at a higher point than a 30 degree line rising rearward through the center of gravity of the kite, as viewed in a horizontal configuration. Although the kite will rotate about a center of rotation which includes the tether in its determination in most aspects of tethered flight, in hover mode the tether tension may vary, and thus the center of rotation in pitch may also vary between the center of mass of the kite and a location towards the tether.

FIGS. 5A and 5B are diagrams illustrating embodiments of a kite. In the examples shown, the tail wing 512 is shown in two orientations relative to the kite 501. Coordinate system 518 is assumed to be affixed to the kite 501. The tail wing 512 is located at a significant negative location on x axis 516 relative to both the attachment point of the tether 502 to the kite 501, or to the center of mass 520 of the kite 501. The main wing 512 is located at a significant negative location on z axis 515 relative to both the attachment point of the tether 502 to the kite 501, and to the center of mass 520 of the kite 501. Axis 517 is perpendicular to both x axis 516 and z axis 515. The tail wing 512 is further capable of being partially or fully rotated by means of mechanical or aerodynamic actuation. FIG. 5A illustrates the tail wing 512 positioned roughly parallel to the main wing 511 such that the tail wing 512 will maintain primarily attached aerodynamic flow in some or all of the range of conditions for which main wing 511 maintains primarily attached aerodynamic flow. In this orientation the tail wing 512 augments the stability of kite 501 by providing an aerodynamic restoring force in addition to an aerodynamic damping force. The orientation as seen in FIG. 5A may be used in stationary or cross wind flight in some aspects.

FIG. 5B illustrates the tail wing 512 positioned roughly perpendicular to the main wing 511 such that for apparent wind antiparallel to z axis 515, the tail wing 512 will maintain attached aerodynamic flow and provide both an aerodynamic restoring force and an aerodynamic damping force. The configuration as seen in FIG. 5B may be illustrative of the hover mode. The tail wing 512 may be actuated to provide desired control forces or may be held fixed in each mode of flight. In various embodiments, the tail wing 512 is rotated by means of a mechanical actuator or by means of the movement of an aerodynamic control surface. In some embodiments, the tail wing 512 rotates about a fixed point located within the airfoil. In various embodiments, the tail wing 512 rotates about some other point or a virtual center or the structure supporting the tail wing 512, rotates with wing 512, or any other appropriate manner of rotation. In some embodiments, multiple wings rotate to serve the function of the tail wing 512. In some embodiments, other wings or control surfaces rotate or deflect to modify the aerodynamic characteristics of the kite 501.

In some embodiments, the system is designed such that it maintains static aerodynamic balance at all moments of transition between the crosswind or static modes of flight and the hover mode of flight. For example, a kite which is able to transition between flight modes at an arbitrarily slow rate in high winds. The kite includes surfaces that engage wind with enough control authority (e.g., a sufficient area on a tail control surface that has a moment arm to change the attitude of the kite) to compensate for the time varying forces of buffeting the main wing (e.g., wind gusts on the wing)

In some embodiments, the system is designed such that the kite must undergo dynamic maneuvers to transition between flight modes. For example, the kite executes a maneuver, where the maneuver once started needs to finish. In other words, there is no way to control the kite in the middle of the maneuvers to stop the maneuver (or restart after stopping). So, a kite enters the hover mode by pitching up so that it heads straight up slowing down, and when close to stopping in a vertical position, the kite enters its hovering mode.

Figure 5C:
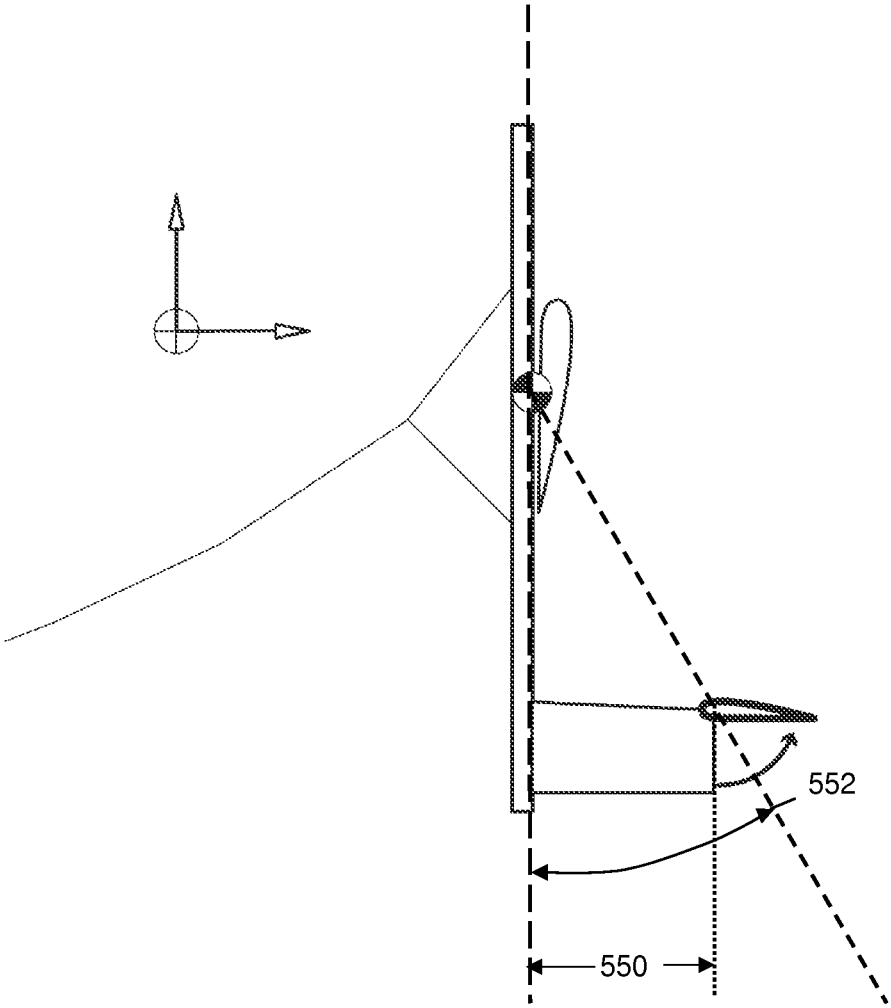
FIG. 5C is a diagram of kite and tail wing geometry according to some embodiments of the present invention.

FIG. 5C illustrates some of the geometric parameters seen with kite 501 when the tail wing 512 is actuated to a position as may be used in hover mode. In this illustrative example, the kite may be facing directly upward, and the wind may be hitting the kite directly perpendicular to the bottom of the main wing. In this situation, the lift of the tail wing may be altered to impart a moment around the center of mass, or the center of rotation, of the kite. The altering of the lift of the tail wing will result in a change in pitch of the kite, as the change in lift is levered around the distance 550 that the center of lift of the tail wing is rearward (in this configuration) of the center of mass of the kite. The angle 552 of a line drawn through the center of mass of the kite to the center of lift of the tail wing represents the functional range that changes in lift may be used to correlate changes in lift of the tail wing to a force in the same corresponding direction around the center of mass of the kite. Once the kite has pitched backward to the degree 552 of this line, an increase in lift of the tail wing will result in a pitch up, whereas until that degree an increase in lift of the tail wing will result in a pitch down. The distance 550 that the center of lift of the tail wing resides rearward of the center of the mass of the kite in this configuration dictates how many degrees off of vertical the kite may be controlled (using the same force sense) in the hover mode.

Figure 5D:
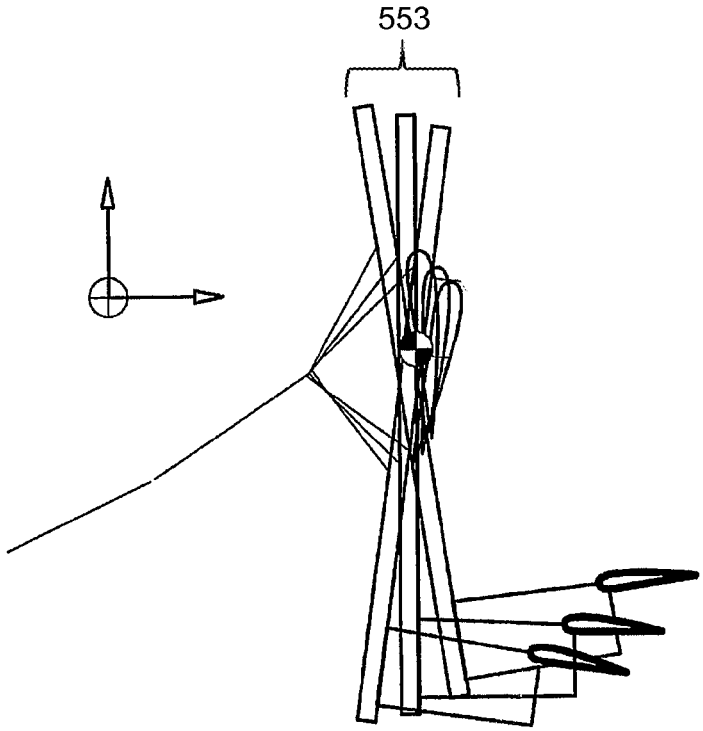
FIG. 5D is a diagram of various kite and tail wing positions according to some embodiments of the present invention.

FIG. 5D illustrates a variety of pitch conditions of the kite 553 during hover mode. As seen, the rearward aspect of the tail wing in this configuration (representing a raised aspect during horizontal flight) allows for pitch control utilizing changes in tail wing lift during a variety of possible positions. The rearward aspect of the tail wing allows for sufficient control during a variety of possible conditions, such as wind gusts or other deviations from vertical flight during hover mode.

Figure 5E:
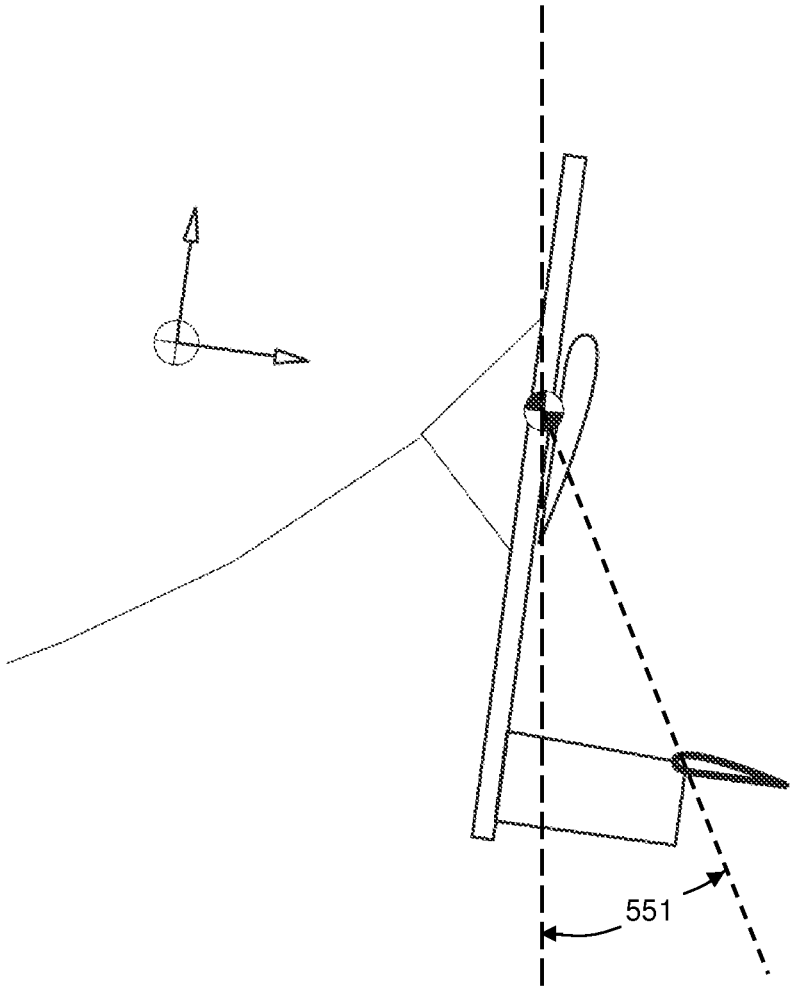
FIG. 5E is a diagram of a kite in hover mode with a pitch orientation according to some embodiments of the present invention.

FIG. 5E illustrates the kite 501 in a partially pitched rearward aspect during a hover mode operation. Despite the rearward pitch off of vertical, there is still sufficient angle 551 to allow for good control and pitch stability against wind gusts of the system. In some embodiments, the motor driven propellers of the kite will combine with the wind to deliver an apparent wind to the tail wing such that even more control may be available.

Figure 6:
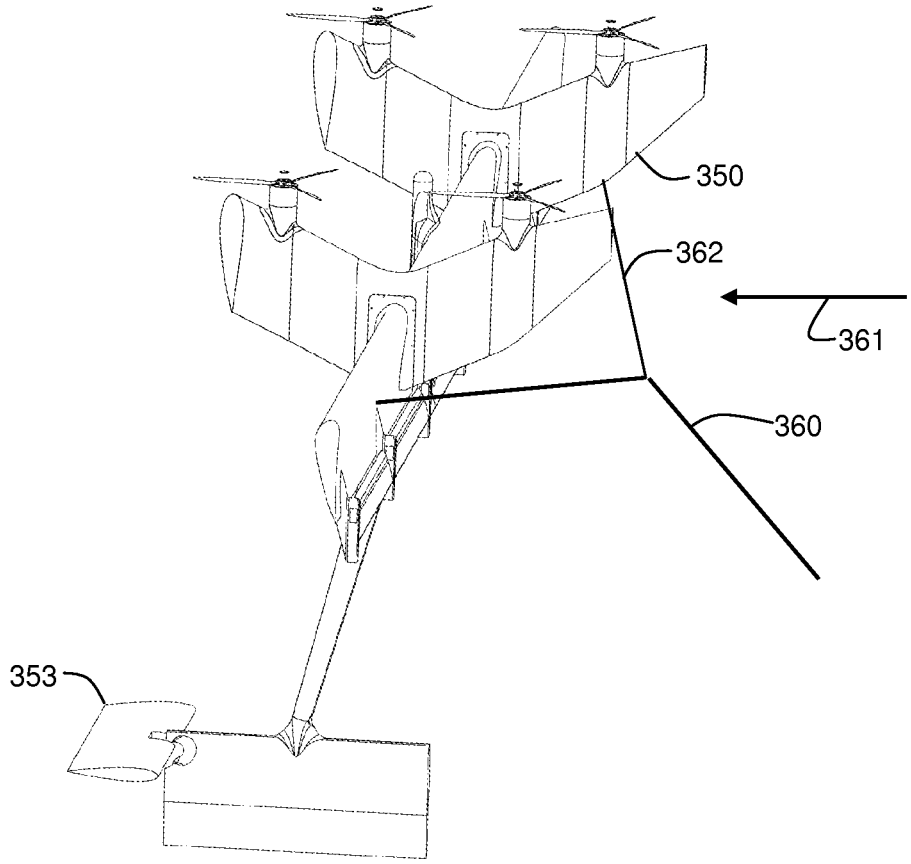
FIG. 6 is a drawing of a kite according to some embodiments of the present invention.

In some embodiments of the present invention, as seen in FIG. 6, the kite 350 is seen in hover mode attached to the bridles 362, which attach to the tether 360. The tail wing 353 is in a horizontal position roughly perpendicular to the main wing in this configuration. The wind direction 361 is seen substantially perpendicular to the main wing. Bridles 362 create a torque on the kite 350 when the tether 360 exerts a force which is not symmetric in kite roll. In such embodiments, the bridles 362 restore the roll angle of the kite after disturbances, provided that some tether tension is present. By this means, the kite 350 may be hovered without sufficient control input to actively maintain a desired roll, or without any active roll control mechanism or control algorithm. In some embodiments of the present invention, bridles such as bridles 362 are not present, and tether 360 attaches directly to kite 350. In some such embodiments, the attachment point is placed to emulate the effect of bridles 362. In other embodiments, kite 350 may maintain some other means of roll control in hover.

In some embodiments of the present invention, the apparent wind of over the tail wing is a resultant of the actual wind and the propwash over the tail wing during flight in the hover mode. The tail wing may be used a lifting wing in the apparent wind and effect pitch control as described above.

Figure 7:
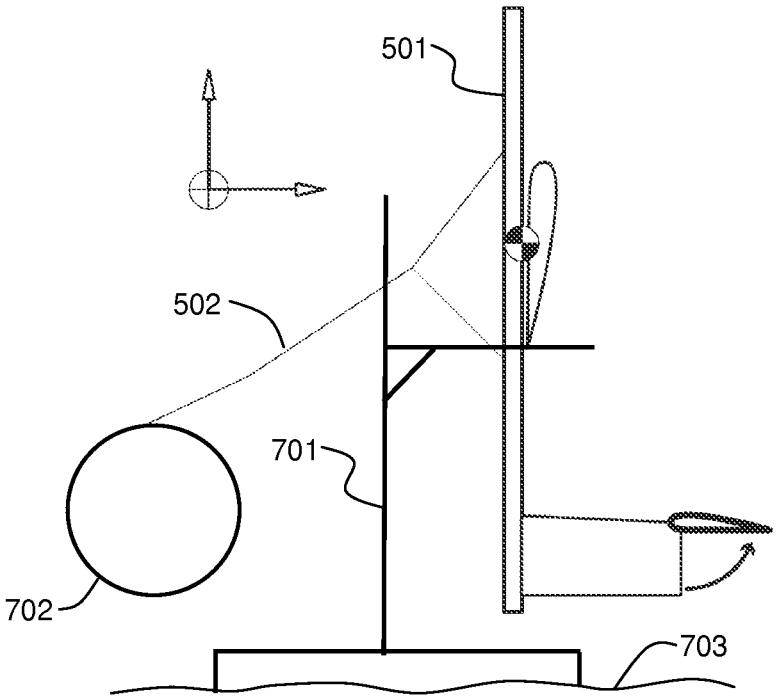
FIG. 7 is a sketch of a kite mounted on a take-off structure according to some embodiments of the present invention.

In some embodiments of the present invention, as seen in FIG. 7, the kite 501 is seen mounted to a support structure 701 adapted to receive the kite 501 during a landing, and to support the kite 501 prior to take off. In some embodiments, a winch 702 may be adapted to reel in the tether 502 during landing of the kite 501. The support structure 701 may reside on the ground 703 in some aspects, or in other locations.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A kite comprising:

a main wing;

a tail wing; and a tail boom, said tail boom attached to said main wing on a first end, said tail boom coupled to said tail wing on a second end, wherein said tail wing is mounted behind and above said main wing, and wherein said tail wing is adapted to rotate to control a pitch of said kite based on an angle between (i) a line through a center of mass of said kite and a center of lift of said tail wing, and (ii) a vertical axis through said center of mass of said kite when said main wing is in a vertical position.

2. The kite of claim 1 wherein said tail wing comprises a fully rotatable wing adapted to rotate relative to said main wing.

3. The kite of claim 2 wherein said tail wing is adapted to rotate from a first position parallel to said main wing to a second position perpendicular to said main wing.

4. The kite of claim 2 wherein said tail wing is adapted to rotate from a first position parallel to said main wing to a second position 20 degrees past perpendicular to said main wing.

5. The kite of claim 3 wherein said kite further comprises a plurality of turbine driven generators.

6. The kite of claim 5 wherein said plurality of turbine driven generators is adapted to function as motor driven propellers.

7. The kite of claim 2 wherein said tail wing is adapted to rotate above a point on a line that is angled at 20 degrees off of said vertical axis through said center of mass.

8. The kite of claim 2 wherein said tail wing is adapted to rotate above a point on a line that is angled at 30 degrees off of said vertical axis through said center of mass.

9. A method comprising the steps of:

causing a kite to lift off of the ground in a hover mode of flight, said kite comprising a main wing and a tail wing rearward and above said main wing, said kite oriented vertically in said hover mode of flight; and controlling a pitch of said kite during said hover mode of flight at least in part by rotating said tail wing, wherein said tail wing is adapted to rotate at least ninety degrees from vertical, and wherein said tail wing is adapted to control the pitch of said kite based on an angle between (i) a line through a center of mass of said kite and a center of lift of said tail wing, and (ii) a vertical axis through said center of mass of said kite when said main wing is in a vertical position.

10. The method of claim 9 further comprising the step of reeling out a tether after said kite lifts off a ground perch, wherein said tether is attached to said kite on a first end and to a ground station on a second end.

11. The method of claim 10 further comprising the step of transitioning from said hover mode of flight to a forward flight mode, wherein said kite is oriented horizontally in said forward flight mode.

12. The method of claim 11 further comprising the step of transitioning from said forward flight mode to said hover mode of flight.

13. The method of claim 12 further comprising the step of landing said kite in said hover mode of flight, wherein the landing comprises controlling said pitch of said kite at least in part by rotating said tail wing.

14. The method of claim 9 wherein said kite is mounted in a ground receiving fixture, and wherein said step of causing a kite to lift off of the ground in a hover mode of flight comprises causing said kite to lift off from said ground receiving fixture.

15. The method of claim 13 wherein said step of landing said kite comprises landing said kite into a ground receiving fixture.

16. The method of claim 9 further comprising the step of controlling a roll of said kite during said hover mode of flight with the use of at least one bridle between said kite and a tether, wherein said at least one bridle is adapted to provide at least one force that causes a change in said roll of said kite.

17. A system comprising:

a ground station;

a tether, said tether attached to said ground station on a first end and to a kite on a second end; and a kite, said kite comprising:

a main wing;

a tail wing; and a tail boom, said tail boom attached to said main wing on a first end, said tail boom coupled to said tail wing on a second end, wherein said tail wing is mounted behind and above said main wing, and wherein said tail wing is adapted to rotate to control a pitch of said kite based on an angle between (i) a line through a center of mass of said kite and a center of lift of said tail wing, and (ii) a vertical axis through said center of mass of said kite when said main wing is in a vertical position.

18. The system of claim 17 wherein said tail wing comprises a fully rotatable wing adapted to rotate relative to said main wing.

19. The system of claim 18 wherein said tail wing is adapted to rotate from a first position parallel to said main wing to a second position perpendicular to said main wing.

20. The system of claim 18 wherein said tail wing is adapted to rotate from a first position parallel to said main wing to a second position past perpendicular to said main wing.

21. A kite comprising:

a center of mass;

a main wing;

a tail wing, wherein said tail wing comprises a fully rotatable wing adapted to rotate relative to said main wing; and a tail boom, said tail boom attached to said main wing on a first end, said tail boom coupled to said tail wing on a second end, wherein said tail wing is mounted behind and above said main wing, and wherein said tail wing is adapted to rotate above a point on a line that is angled 20 or 30 degrees off of a horizontal axis through said center of mass when said main wing is in a horizontal position.

* * * * *